United States Patent [19]

Perry

[11] 4,228,958

[45] Oct. 21, 1980

[54] AIR-OPERATED SPRAY DEVICE

[75] Inventor: James C. Perry, Almont, Mich.

[73] Assignee: General Motors Corporation, Detroit, Mich.

[21] Appl. No.: 61,506

[22] Filed: Jul. 27, 1979

[51] Int. Cl.[3] ..... B05B 7/04

[52] U.S. Cl. ..... 239/411; 137/114; 239/412

[58] Field of Search ..... 137/114; 239/410–412, 239/526, 533.1, 533.15, 570

[56] References Cited

U.S. PATENT DOCUMENTS

| | | | |
|---|---|---|---|
| 1,332,544 | 3/1920 | Davis | 239/411 |
| 1,960,724 | 5/1934 | Bramsen | 239/411 |
| 2,401,503 | 6/1946 | Paasche | 239/411 |
| 2,913,187 | 11/1959 | Anderson | 239/412 |
| 3,053,461 | 9/1962 | Inglis | 239/411 |
| 3,194,502 | 7/1965 | West | 239/411 |

FOREIGN PATENT DOCUMENTS

| | | | |
|---|---|---|---|
| 178677 | 9/1936 | Switzerland | 239/412 |

*Primary Examiner*—Andres Kashnikow

*Attorney, Agent, or Firm*—Edward J. Biskup

[57] ABSTRACT

A spray device having a body member including a nozzle at one end thereof formed with an orifice and a pressure chamber formed in the other end thereof. The body member is provided with a first passage which serves to deliver sprayable liquid to the orifice under the control of an axially movable needle valve which is adapted to open and close the orifice. A second passage is formed in the body member for simultaneously directing pressurized air to the pressure chamber and to the nozzle for atomizing the sprayable liquid as it flows through the orifice. An actuator mechanism is provided in the pressure chamber and is operatively connected to one end of the needle valve for controlling flow of the pressurized air between the second passage and the pressure chamber so as to automatically maintain a closing force on the needle valve that is substantially equal to but less than the force required to open the needle valve so as to insure that after initial use of the spray device the needle valve will not open to allow the sprayable liquid to flow to the orifice until the pressurized air is at a pressure sufficient to atomize the sprayable liquid.

3 Claims, 6 Drawing Figures

AIR-OPERATED SPRAY DEVICE

This invention concerns a spray device for atomizing paint and more particularly an air-operated spray device in which the atomization air controls the position of the needle valve to insure that paint will flow only when there is sufficient air pressure to properly atomize the paint.

More specifically, the spray device made in accordance with the present invention includes a body member that has a nozzle at one end provided with an orifice while the other end of the body member is formed with a pressure chamber. A first passage for sprayable liquid is located in the body member and leads to the orifice the opening and closing of which is controlled by one end of an axially movable needle valve located in the passage. The other end of the needle valve extends into the pressure chamber and the latter is connected to a second passage formed within the body member that simultaneously supplies pressurized air to the pressure chamber and to the nozzle for atomizing the liquid as it flows through the orifice. The pressure chamber includes an actuator mechanism which is operatively connected to the other end of the needle valve and is responsive to the atomization air for automatically maintaining a closing force on the needle valve that is substantially equal to but less than the force required to open the needle valve. This arrangement insures that the needle valve does not open to allow the sprayable liquid to flow to the orifice in the nozzle until the pressurized air is at a pressure sufficient to atomize the liquid.

The objects of the present invention are to provide a new and improved air-operated spray gun in which the needle valve actuator mechanism is operated by the atomization air; to provide a new and improved spray device that has a quick on/off action; to provide a new and improved spray gun for use with automatic robot-type spray systems that move at a high rate of speed; and to provide a new and improved air-operated spray gun which automatically maintains a closing force on the needle valve assembly that is substantially equal to the force required to open the needle valve so as to insure that liquid does not flow to the orifice in the nozzle until the air is at a pressure sufficient to atomize the liquid.

Other objects and advantages of the present invention will be more apparent from the following detailed description when taken with the drawings in which.

Figure 1:
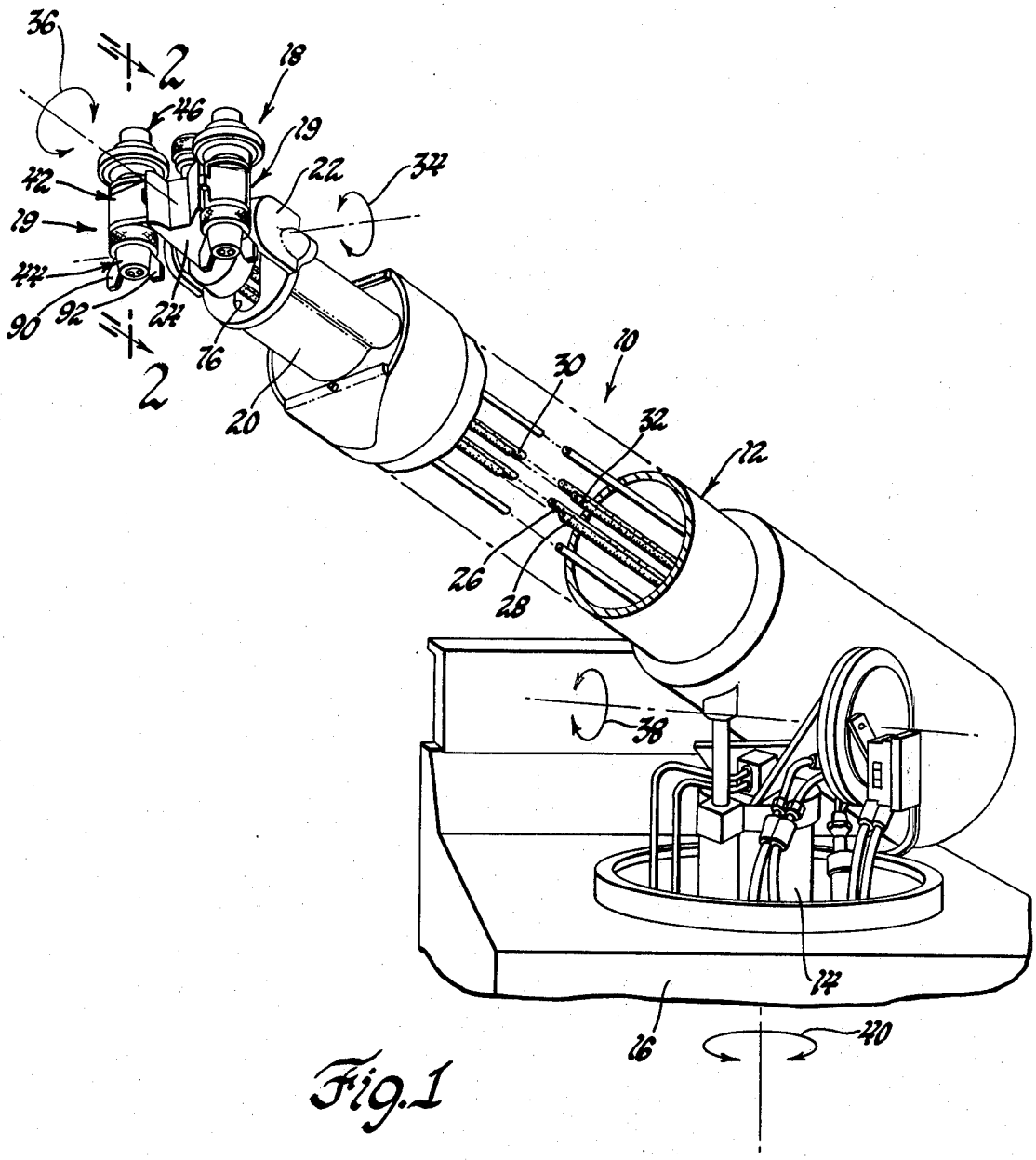
FIG. 1 is a perspective view showing a multi-axis robot equipped with two identical spray guns each of which is made in accordance with the invention.

Referring to the drawings and more particularly FIG. 1 thereof, a multi-axis robot 10 is shown which is suitable for programmed control movement to achieve universal work processing relationship with respect to objects such as a motor vehicle (not shown). The robot 10 comprises an elongated boom or support arm 12 which has the rear end thereof mounted on a pedestal type base 14 that extends into a housing 16. The housing 16 includes the usual control for automatically causing the work end of the robot to move along various axes under the control of a program. In this case, the work end of the robot is provided with a paint spray unit 18 consisting of two identical spray guns 19 each of which is made in accordance with the present invention.

The support arm 12 of the robot 10 includes an elongated tubular member 20 which terminates at its outer end with a wrist assembly 22 which in turn supports the paint spray unit 18. The paint spray unit 18 includes a manifold 24 which has suitable passages formed therein for delivering pressurized air, paint to the spray guns 19. In this case, four flexible lines or hoses 26, 28, 30, 32 serve as conduits for supplying the paint and pressurized air to the manifold 24 from sources (not shown). The wrist assembly 22 includes a gear unit such as shown in copending United States patent application Ser. No. 963,430, filed on Nov. 24, 1978, in the names of Abu-Akeel et al, and assigned to the assignee of this application. The gear unit serves to rotate the paint spray unit 18 along a first circular path 34 and along a second circular path 36. In addition, the rearward end of the support arm 12 is pivotally supported on the base 14 so as to provide pivotal movement of the entire arm about a horizontal axis along a third circular path 38. The base 14 is also rotatable about a vertical axis along a fourth circular path 40 so that the entire support arm 12 can swing in an arc and position the paint spray unit 18 at different locations. Thus, it should be apparent from the above description that the robot has four degrees of freedom which permit the machine to perform spraying operation in various locations.

As best seen in FIGS. 2, 4, 5 and 6, each spray gun 19 comprises a main body portion 42, a nozzle portion 44 and a control portion 46. The body portion 42 is formed with four ports 48, 50, 52 and 54 which, through the manifold 24, connect with the four conduits 26, 28, 30 and 32 located within the support arm 12 of the robot 10. In this connection, it will be noted that conduit 26 supplies the paint to be sprayed and is connected with port 48 of each of the spray guns 19. Conduits 28 and 30 supply pressurized air and are respectively connected to ports 50 and 52 of the spray guns while conduit 32 includes a dump valve and is connected with port 54 in the main body portion 42 of the spray gun 19. As is conventional with vehicle paint spraying units, conduit 32 serves as a return line for the solvent during a cleaning operation of the spray guns preparatory to changing the color of the paint.

Figure 2:
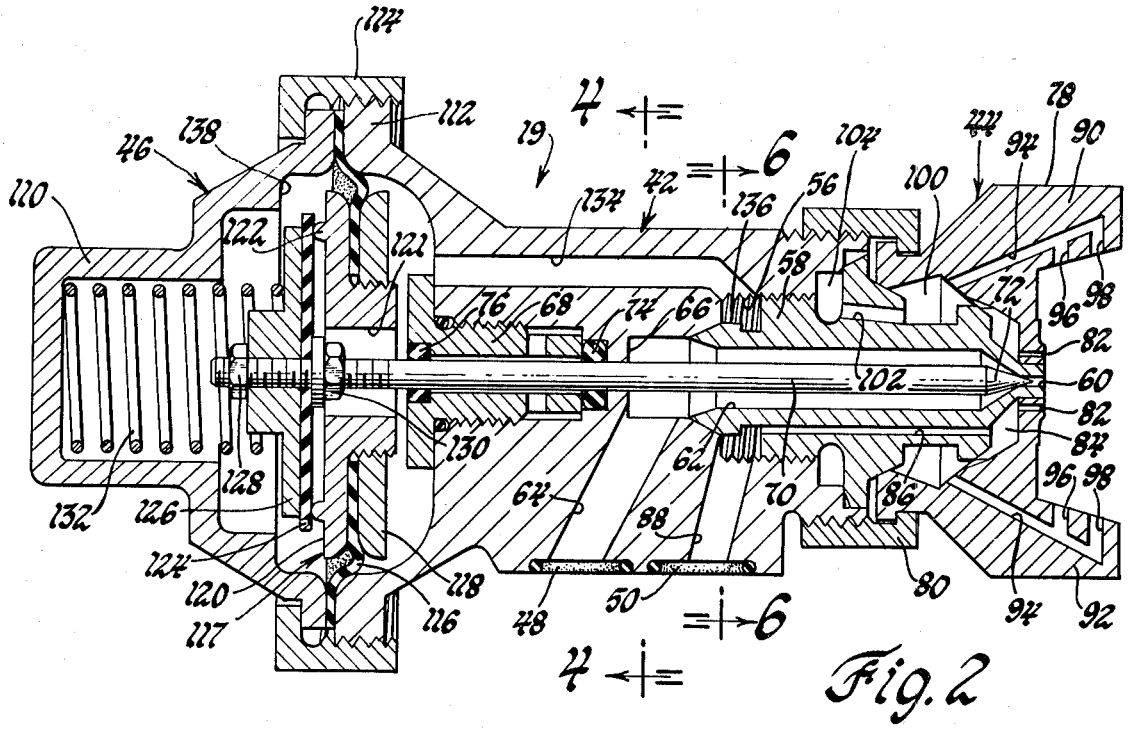
FIG. 2 is an enlarged cross-sectional view taken on line 2—2 of FIG. 1 and shows one of the spray guns in detail but rotated 90° so as to illustrate the spray gun in a horizontal attitude.

As best seen in FIG. 2, the main body portion 42 is formed with a centrally located longitudinally extending stepped bore the forward end portion 56 of which is threaded and receives the rear end of a tubular liquid nozzle 58 which is provided with an orifice 60. The stepped bore in the main body portion 42 registers with a longitudinal bore 62 formed in the liquid nozzle 58 that connects with the orifice 60. In addition, the bore 62 is connected with a passage 64 leading to port 48 which supplies sprayable liquid paint to the spray gun 19. It will be noted that the rear portion of the stepped bore in the main body portion 42 includes a radially inwardly extending annular boss 66 which, together with a threaded fitting 68, serves as a guide means for providing accurate axial movement of a needle valve 70, the pointed forward end 72 of which serves to open and close the orifice 60. A pair of seals 74 and 76 are provided at opposite ends of the fitting 68 for maintaining sealed separated areas in the spray gun 19.

Figure 6:
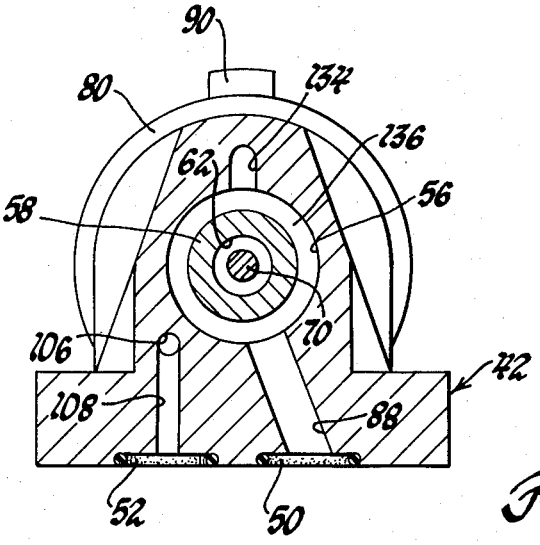
FIG. 6 is a cross-sectional view taken on line 6—6 of FIG. 2.

The nozzle portion 44 of the spray gun 19 also includes an air nozzle 78 which is fitted upon forwardly tapering portions of the liquid nozzle 58 and is sealingly clamped against the latter nozzle by a clamping ring 80 threaded upon the forward end of the main body portion 42. The central portion of the air nozzle 78 is formed with longitudinally extending orifices, two of which are shown in FIG. 2 of the drawings and identified by the reference numeral 82. The orifices 82 are equally spaced from and surround the liquid orifice 60 and connect with an annular chamber 84, which in turn, connects with a longitudinal passage 86 formed in the liquid nozzle 58. The passage 86, in turn, connects with a radially extending passage 88 which leads to the port 50. Thus, when pressurized air is connected to the port 50, it flows via passages 88 and 86 into the chamber 84 and exits through orifices 82 to atomize the paint flowing through the orifice 60. As is conventional, the air nozzle 78 has the body portion thereof formed with a pair of wing members 90 and 92, each of which has a passage 94 formed therein that connects with openings 96 and 98 for controlling the pattern of the atomized paint as it flows from the spray gun 19. Each of the passages 94 connects with an annular chamber 100, which in turn, is connected with a passage 102 in the liquid nozzle 58 that leads to an annular chamber 104. The annular chamber 104, in turn, receives air from a longitudinally extending bore 106 formed in the main body portion 42 as seen in FIG. 6. The bore 106, is connected via a radially extending passage 108 to the port 52.

Figure 5:
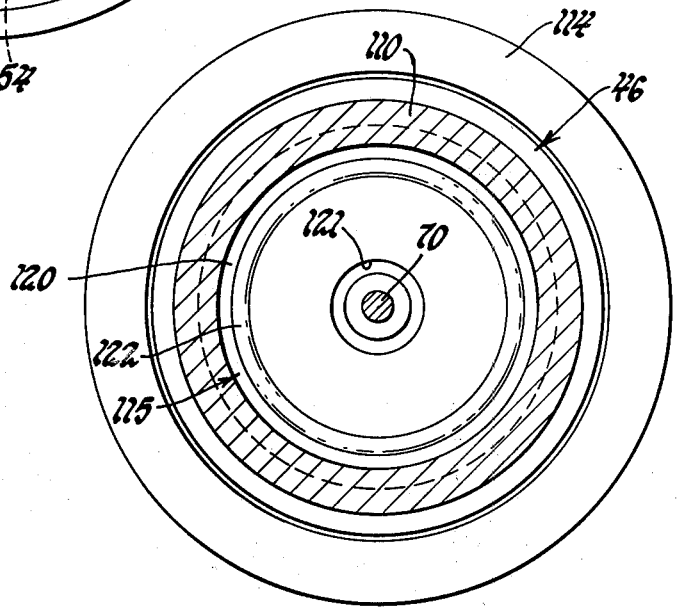
FIG. 5 is a view taken on line 5—5 of FIG. 3.

The control portion 46 of the spray gun 19 includes an actuator mechanism which serves to control the position of the needle valve 70. The actuator mechanism is located within a pressure chamber that is defined by a hat shaped end cap 110 and the rear portion of the main body portion 42. The end cap 110 is clamped to a radially extending flange 112 formed with the main body portion 42 by a threaded clamping collar 114. A diaphragm member 117 forms a part of the actuator mechanism and comprises a diaphragm circular 116 and a pair of retainer members 118 and 120. The peripheral portion of the circular diaphragm 116 is clamped between the end cap 110 and the flange 112 and has its inner end sealingly fixed between the threadably interconnected retainer members 118 and 120 the latter of which is formed with a central circular opening 121. As seen in FIGS. 2 and 5, the retainer member 120 is formed with a circular projection 122 which is uniform in cross section and is adapted to normally engage a disc member 124 formed of a resilient material such as neoprene or rubber. The disc member 124 is held in position against an annular support member 126 which, in turn, is fixed to the threaded rear end of the needle valve 70 by a pair of nuts 128 and 130. It will be noted that the opening 121 in retainer member 120 of the diaphragm member 117 serves to communicate the area adjacent the fitting 68 with the outer surface of the disc member 124 as defined by the annular projection 122. A coil spring 132 is located in the pressure chamber and has one end engaging the end cap 110 while the other end engages the support member 126 so as to maintain a closing, biasing force on the needle valve 70. Thus, as seen in FIG. 2, the spring 132, acting against the support member 126, serves to force the tapered pointed end of the needle valve 70 into the orifice 60 so as to close the latter and prevent liquid from flowing therethrough. It will also be noted that the pressure chamber of the control portion 46 of the spray gun 19 is continuously connected with port 50 which supplies compressed air for atomizing the sprayable liquid. In this regard, the pressure chamber of the control portion 46 connects with a longitudinal passage 134 formed in the main body portion 42. The passage 134, in turn, leads to an annular chamber 136 surrounding the rear end of the liquid nozzle 58 and connects with the port 50.

The operation of the spray gun made according to the present invention is as follows:

As seen in FIG. 2 of the drawings, the various parts of the spray gun 19 are in the normal position prior to operation. Initially, a valve (not shown) controlling flow of paint through conduit 26 will be opened to direct the sprayable liquid paint to the port 48. Afterwards, a control valve (not shown) in conduit 28 is opened to supply compressed air to the port 50. Compressed air entering the port 50 flows via passages 88 and 86 to the orifices 82 formed in the air nozzle 78. At the same time, the compressed air flows via chamber 136 and passage 134 to the pressure chamber. With the needle valve 70 in the closed position of FIG. 2, nothing occurs at this time. It will be noted, however, that with the projection 122 of the diaphragm member 117 engaging the disc member 124, the pressure chamber is divided into a rear chamber and a front chamber with the rear chamber in which the spring 132 is located being sealed from the front chamber in which the head end of the fitting 68 is located. Accordingly, as the compressed air builds up in pressure, it acts against the right-hand surface of the diaphragm member 117 and the outer surface of the disc member 124. Depending upon the amount of pressure acting on the two members and the strength of the spring 132, the needle valve 70 will either maintain the position shown in FIG. 2 or begin to move to the left to open the orifice 60. In other words, as the air pressure begins to build up and exceed the force of the spring 132, the diaphragm member 117 together with the support member 126 and disc member 124 will be gradually moved as a unit to the left. It will be noted that as the diaphragm member 117 and the support member-disc member combination move from the position shown in FIG. 2 to that shown in FIG. 3, the diaphragm member 117 will continue its movement to the left only until it engages an annular shoulder 138 formed on the end cap 110. At this point, the needle valve 70 is in the fully opened position. If the air pressure continues to increase, it will act on the right-hand outer surface of the disc member 124 as defined by the annular projection 122 of the diaphragm member 117 and assuming the force acting thereon exceeds the force of the spring 132, the support member-disc member combination will move to the left relative to the diaphragm member 117. At this point, the pressurized air will flow into the rear chamber containing the spring 132 and, of course, act on the left-hand outer surface of the support member 126 causing the disc member 124 to move to the right into engagement once again with the projection 122 on the diaphragm member 117. Once the pressurized air is stabilized at a fixed pressure, which will be the air pressure providing the desired atomization, the actuator mechanism will maintain the position of FIG. 3 allowing paint to flow through the nozzle 58 and at the same time atomizing the paint by means of the compressed air flowing through the orifices 82. As is conventional, the pattern of the atomized paint being emitted from the gun will be controlled by adjusting the pressure of the air in conduit 30 which connects with port 52 and is connected to the openings 96 and 98 in the wing members 90 and 92 of the air nozzle 78 as aforedescribed.

Figure 3:
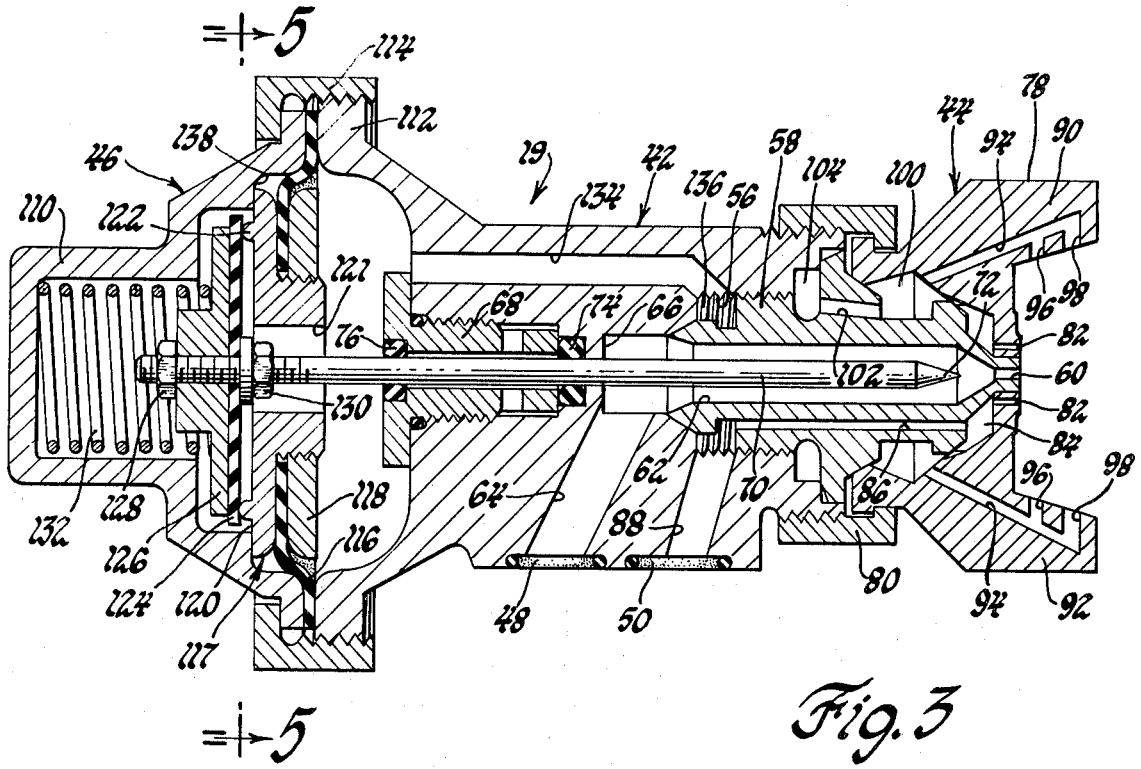
FIG. 3 is a view similar to FIG. 2, but shows the needle valve of the spray gun in the fully opened position.
Figure 4:
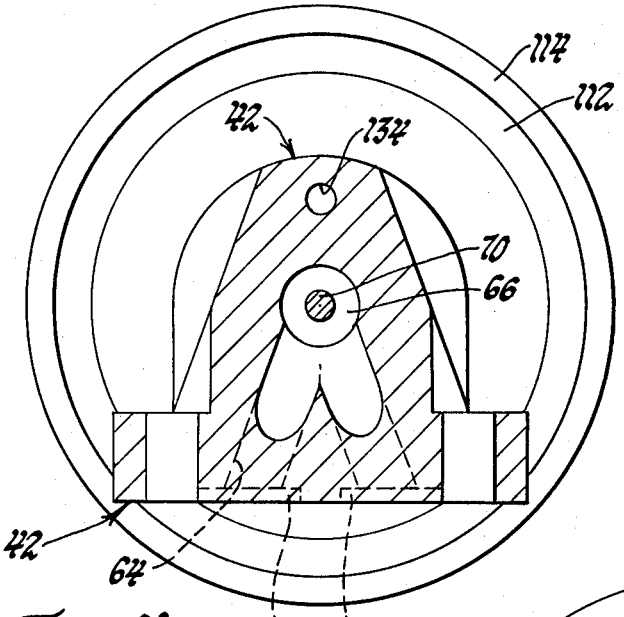
FIG. 4 is a cross-sectional view taken on line 4—4 of FIG. 2.

From the above description, it should be apparent that with the force of the spring 132 being augmented by the compressed air flowing into the rear chamber as explained above, a delicate balance is provided for maintaining the diaphragm member 117 in the position of FIG. 3. Accordingly, a slight drop in pressure of the compressed air in the front chamber will cause the support member 126, under the urging of the spring 132 and the pressurized air in the rear chamber, to quickly shift the needle valve 70 to the right to close the orifice 60. Inasmuch as the rear chamber is sealed from the front chamber when the disc member 124 is in engagement with the projection 122, the pressurized air which flows to the rear chamber will remain therein after the needle valve 70 is closed. Thus, the rear chamber has a residual pressure which augments the force of the spring 132 and must be overcome in order to again open the needle valve 70. In other words, the next time that compressed air is introduced into the front chamber, it must rise to a level sufficient to overcome the force due to the residual air pressure in the rear chamber and also the force of the spring 132 before the needle valve 70 is unseated. The net result of this sequence is that the opening of the orifice 60 is delayed until the compressed air is at atomizing pressure and also closure of the orifice 60 will occur with a slight drop in the atomizing pressure. This means that paint can flow only while there is sufficient atomizing air pressure to atomize the paint and quick closing of the orifice 60 occurs so that paint dripping at the nozzle portion 44 is prevented.

A spray gun made in accordance with the present invention has been successfully tested utilizing an air nozzle 78 and a liquid nozzle 58 made by Binks Manufacturing Company, of Franklin Park, Illinois, and identified, respectively, as part numbers 63PR and 63C. The needle valve 70 used was also manufactured by Binks Manufacturing Company and was identified as part number 363A. The needle valve 70 was modified slightly so that it would have a length of 100 mm and a diameter of 0.140 mm with the rear end of the needle valve 70 being provided with threads as shown in the drawings. The diaphragm member 117 had a diaphragm 116 made from neoprene with the outer diameter measuring 58 mm, the inner opening measuring 21 mm in diameter and a thickness of 0.8 mm. The spring 132 in the control portion 46 of the spray gun 19 was made by Associated Spring Company, of Bristol, Connecticut, and was identified as part number C0720-065-1250. The spring 132 had an outer diameter measuring 18.29 mm and a free length of 31.75 mm and was rated at 24.4 lbs. per inch.

Various changes and modifications can be made in this construction without departing from the spirit of the invention. Such changes and modifications are contemplated by the inventor and he does not wish to be limited except by the scope of the appended claims.

The embodiments of the invention in which an exclusive property or privilege is claimed are defined as follows:

1. A spray device comprising in combination a body member including a nozzle at one end thereof, said nozzle having an orifice formed therein, a pressure chamber formed in the other end of the body member, a first passage for sprayable liquid located in said body member and leading to said orifice in the nozzle, an axially movable needle valve in said first passage, one end of said needle valve adapted to open and close said orifice, the other end of said needle valve extending into said pressure chamber and having a support member connected thereto, a spring in said pressure chamber contacting said support member and urging said needle valve to a closed position, a source of pressurized air at a predetermined pressure, said body member having a second passage formed therein for simultaneously connecting said source of pressurized air to said pressure chamber and to said nozzle for atomizing the liquid as it flows through the orifice, and a flexible member in said pressure chamber cooperating with said support member for allowing pressurized air to flow from said second passage into said pressure chamber and thereby augment the force of said spring so as to maintain a closing force on said needle valve that is substantially equal to but less than the force required to open the needle valve whereby said needle valve will not open to allow the sprayable liquid to flow to the orifice in the nozzle until the pressurized air is at a pressure sufficient to atomize said sprayable liquid.

2. A spray device comprising in combination a body member including a nozzle at one end thereof, said nozzle having an orifice formed therein, a pressure chamber formed in the other end of the body member, a first passage for sprayable liquid located in said body member and leading to said orifice in the nozzle, an axially movable needle valve in said first passage, one end of said needle valve adapted to open and close said orifice, the other end of said needle valve extending into said pressure chamber and having a disc member mounted thereto, a spring in said pressure chamber contacting the disc member and urging said needle valve to a closed position, a source of pressurized air at a predetermined pressure, said body member having a second passage formed therein for simultaneously connecting said source of pressurized air to said pressure chamber and to said nozzle for atomizing the the liquid as it flows through the orifice, a flexible member in said pressure chamber having an opening through which said needle valve extends, said flexible member cooperating with said disc member for controlling the flow of pressurized air from said second passage into said pressure chamber via said opening to augment the force of said spring and thereby maintain a closing force on said needle valve that is substantially equal to but less than the force required to open the needle valve so as to insure that said needle valve will not open to allow the sprayable liquid to flow to the orifice in the nozzle until the pressurized air is at a pressure sufficient to atomize said sprayable liquid.

3. A spray device comprising in combination a body member including a nozzle at one end thereof, said nozzle having an orifice formed therein, a pressure chamber formed in the other end of the body member, a first passage for sprayable liquid located in said body member and leading to said orifice in the nozzle, an axially movable needle valve in said first passage, one end of said needle valve adapted to open and close said orifice, the other end of said needle valve extending into said pressure chamber and having a resilient disc member mounted thereon, a spring in said pressure chamber contacting the disc member so as to continuously bias said needle valve to a closed position, a source of pressurized air at a predetermined pressure, said body member having a second passage formed therein for simultaneously connecting said source of pressurized air to said pressure chamber and to said nozzle for atomizing the liquid as it flows through the orifice, a diaphragm member in said pressure chamber having an opening through which said needle valve extends, said diaphragm member having means formed therewith for cooperation with said disc member for controlling the flow of pressurized air from said second passage into said pressure chamber via said opening and for maintaining said pressurized air therein to supplement the force of said spring and thereby provide a closing force on said needle valve that is substantially equal to but less than the force required to open the needle valve so as to insure that after the first use of said spray device said needle valve does not open to allow the sprayable liquid to flow to the orifice in the nozzle until the pressurized air is at a pressure sufficient to atomize said sprayable liquid.

* * * * *